US010450905B2

(12) United States Patent
Yamakawa et al.

(10) Patent No.: US 10,450,905 B2
(45) Date of Patent: Oct. 22, 2019

(54) VARIABLE VALVE TIMING CONTROL DEVICE

(71) Applicant: AISIN SEIKI KABUSHIKI KAISHA, Kariya-shi, Aichi-ken (JP)

(72) Inventors: Yoshiaki Yamakawa, Novi, MI (US); Masaki Kobayashi, Okazaki (JP); Hiromitsu Shigyo, Toyota (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 48 days.

(21) Appl. No.: 15/916,374

(22) Filed: Mar. 9, 2018

(65) Prior Publication Data

US 2018/0274398 A1 Sep. 27, 2018

(30) Foreign Application Priority Data

Mar. 23, 2017 (JP) ..... 2017-057839

(51) Int. Cl.

| | |
|---|---|
| ***F02D 13/04*** | (2006.01) |
| ***F01L 1/344*** | (2006.01) |
| ***F01L 1/356*** | (2006.01) |
| *F02D 13/00* | (2006.01) |

(52) U.S. Cl.

CPC ..... *F01L 1/3442* (2013.01); *F01L 1/356* (2013.01); *F01L 2001/3443* (2013.01); *F01L 2001/34433* (2013.01); *F01L 2001/34463* (2013.01); *F01L 2001/34466* (2013.01); *F01L 2001/34473* (2013.01); *F01L 2250/02* (2013.01)

(58) Field of Classification Search

CPC .... F02D 31/002; F02D 31/003; F02D 31/006; F02D 13/0207; F02D 13/0246; F02D 2041/001; F02D 13/0226; F02D 41/0002; F01L 13/0015; F01L 2800/00

USPC ..... 123/319, 321, 345–348

See application file for complete search history.

(56) References Cited

U.S. PATENT DOCUMENTS

| | | | | |
|---|---|---|---|---|
| 2015/0033907 | A1* | 2/2015 | Iyanaga | F16H 25/08 74/568 T |
| 2016/0017767 | A1* | 1/2016 | Nunami | F01L 1/3442 123/90.12 |
| 2016/0169061 | A1* | 6/2016 | Iwaya | F01L 1/3442 123/90.15 |
| 2016/0298504 | A1 | 10/2016 | Kobayashi et al. | |
| 2017/0234174 | A1 | 8/2017 | Yamakawa et al. | |

(Continued)

FOREIGN PATENT DOCUMENTS

| | | |
|---|---|---|
| JP | 2015-078635 A | 4/2015 |
| JP | 2016-089664 A | 5/2016 |

*Primary Examiner* — John Kwon

(74) *Attorney, Agent, or Firm* — Buchanan Ingersoll & Rooney PC

(57) ABSTRACT

A variable valve timing control device includes a valve unit including a spool having a plurality of land portions at an outer circumference of the spool, and being formed with a drain flow path inside the spool. The valve unit allows a second pump port and a lock port to communicate with each other in a case where the spool is set at an unlock position where a lock state of a lock mechanism is released, and the valve unit closes the second pump port with the land portion of the spool and allows the lock port to communicate with the drain flow path in a case where the spool is set at a lock position where the lock mechanism is allowed to be shifted in the lock state.

11 Claims, 8 Drawing Sheets

(56) References Cited

U.S. PATENT DOCUMENTS

| | | | | |
|---|---|---|---|---|
| 2018/0238201 | A1* | 8/2018 | Asahi | F01L 1/3442 |
| 2018/0245488 | A1* | 8/2018 | Hamasaki | F01L 1/3442 |

* cited by examiner

| | PA1 | PA2 | PN | PB2 | PB1 |
|---|---|---|---|---|---|
| Advanced-angle chamber | Supply | Supply | Block | Discharge | Discharge |
| Retarded-angle chamber | Discharge | Discharge | Block | Supply | Supply |
| Lock member | Discharge | Supply | Supply | Supply | Discharge |

VARIABLE VALVE TIMING CONTROL DEVICE

CROSS REFERENCE TO RELATED APPLICATIONS

This application is based on and claims priority under 35 U.S.C. § 119 to Japanese Patent Application 2017-057839, filed on Mar. 23, 2017, the entire content of which is incorporated herein by reference.

TECHNICAL FIELD

This disclosure generally relates to a variable valve timing control device.

BACKGROUND DISCUSSION

A known variable valve timing control device is disclosed in JP2016-89664A (hereinafter referred to as Patent reference 1). Patent reference 1 discloses a technology as the variable valve timing control device in which a spool is coaxially disposed with a rotary axis, the variable valve timing control device controlling a relative rotational phase of an advanced-angle chamber and a retarded-angle chamber by controlling a supply and discharge of fluid relative to the advanced-angle chamber and the retarded-angle chamber by operating the spool, the variable valve timing control device controlling an intermediate lock mechanism.

In Patent reference 1, a lock flow path and a lock discharge flow path for controlling the intermediate lock mechanism are provided. The intermediate lock mechanism is unlocked by the supply of the fluid to the lock flow path, and is shifted in a lock state by the discharge of the fluid from the lock discharge flow path.

As disclosed in Patent reference 1, the variable valve timing control device includes the single spool that is coaxially provided with the rotary axis of the variable valve timing control device, and controls the relative rotational phase and the lock mechanism by the operation of the spool. Such a variable valve timing control device can perform an operation having great responsiveness comparing to a variable valve timing control device controlling a relative rotational phase and a lock mechanism by a control valve disposed outside a variable valve timing control device.

Here, assuming the shift of the lock mechanism to the lock state, because Patent reference 1 includes a configuration in which a lock member of the lock mechanism engages with a recessed portion by biasing force of, for example, a spring to reach the lock state, the fluid is required to be discharged from the recessed portion quickly in order to shift the lock mechanism into the lock state with great responsiveness.

However, for example, in Patent reference 1, in a case where the flow path resistance of the lock discharge flow path is high, or in a case where the fluid is inhibited from flowing from the lock discharge path through the discharge flow path inside the spool, the lock mechanism may not quickly shift to the lock state. Specifically, this phenomenon is prominent when the viscosity of the fluid is enhanced at a low temperature.

Here, the difficulty of the shift to the lock state particularly found in the intermediate lock will hereunder be explained. When the relative rotational phase is shifted to the intermediate lock state, the lock shift may be performed in a state where the relative rotational phase is stopped by a vane that comes in contact with a wall portion, such as, for example, in a state of a most retarded-angle lock or a most-advanced angle lock. Comparing to this configuration, when being shifted to the intermediate lock state, the relative rotational phase needs to be shifted quickly to the lock state when a lock member and a lock recessed portion reach an engageable position in a state where the lock member and the lock recessed portion are always relatively displaced from each other. From this reason, shifting to the lock state is difficult.

Further, it is favorable that the variable valve timing control device is downsized in a direction along the rotary axis. However, because the size of the spool is defined by the number of ports supplying and discharging the fluid, and by the control amount of the fluid, the downsizing of the spool has a limit and the further downsizing of the device is difficult.

A need thus exists for a variable valve timing control device which is not susceptible to the drawback mentioned above.

SUMMARY

According to an aspect of this disclosure, a variable valve timing control device includes a drive-side rotational body rotating synchronously with a crankshaft of an internal combustion engine, a driven-side rotational body being coaxially disposed with a rotary axis of the drive-side rotational body, and rotating integrally with a camshaft for opening and closing a valve, an advanced-angle chamber being formed between the drive-side rotational body and the driven-side rotational body, a retarded-angle chamber being formed between the drive-side rotational body and the driven-side rotational body, a lock mechanism including a recessed portion being formed at one of the drive-side rotational body and the driven-side rotational body, and a lock member being formed at the other of the drive-side rotational body and the driven-side rotational body, the lock member being selectively engageable with the recessed portion, and a valve unit including a connecting bolt which is coaxially disposed with the rotary axis, and which connects the driven-side rotational body to the camshaft. The connecting bolt is formed with an advanced-angle port communicating with the advanced-angle chamber, a retarded-angle port communicating with the retarded-angle chamber, at least one lock port communicating with the recessed portion, a first pump port supplying a fluid from outside to the advanced-angle port and the retarded-angle port, and a second pump port supplying the fluid from outside to the lock port. The advanced-angle port, the retarded-angle port, the lock port, the first pump port, and the second pump port are formed as through holes each of which connects an inner space and an outer circumferential surface of the connecting bolt. The lock port is formed at a same position as a position of the second pump port in the direction along the rotary axis, and is disposed different from the second pump port in a circumferential direction. The valve unit includes a spool having plural land portions at an outer circumference of the spool, and being formed with a drain flow path inside the spool, the valve unit housing the spool which is movable in the direction along the rotary axis relative to the inner space of the connecting bolt. The valve unit allows the second pump port and the lock port to communicate with each other in a case where the spool is set at an unlock position where a lock state of the lock mechanism is released, and the valve unit closes the second pump port with the land portion of the spool and allows the lock port to communicate with the drain flow path in a case where the spool is set at a lock position where the lock mechanism is allowed to be shifted in the lock state.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Embodiments of the present disclosure will hereunder be explained with reference to the drawings.

[Basic Configuration]

Figure 1:
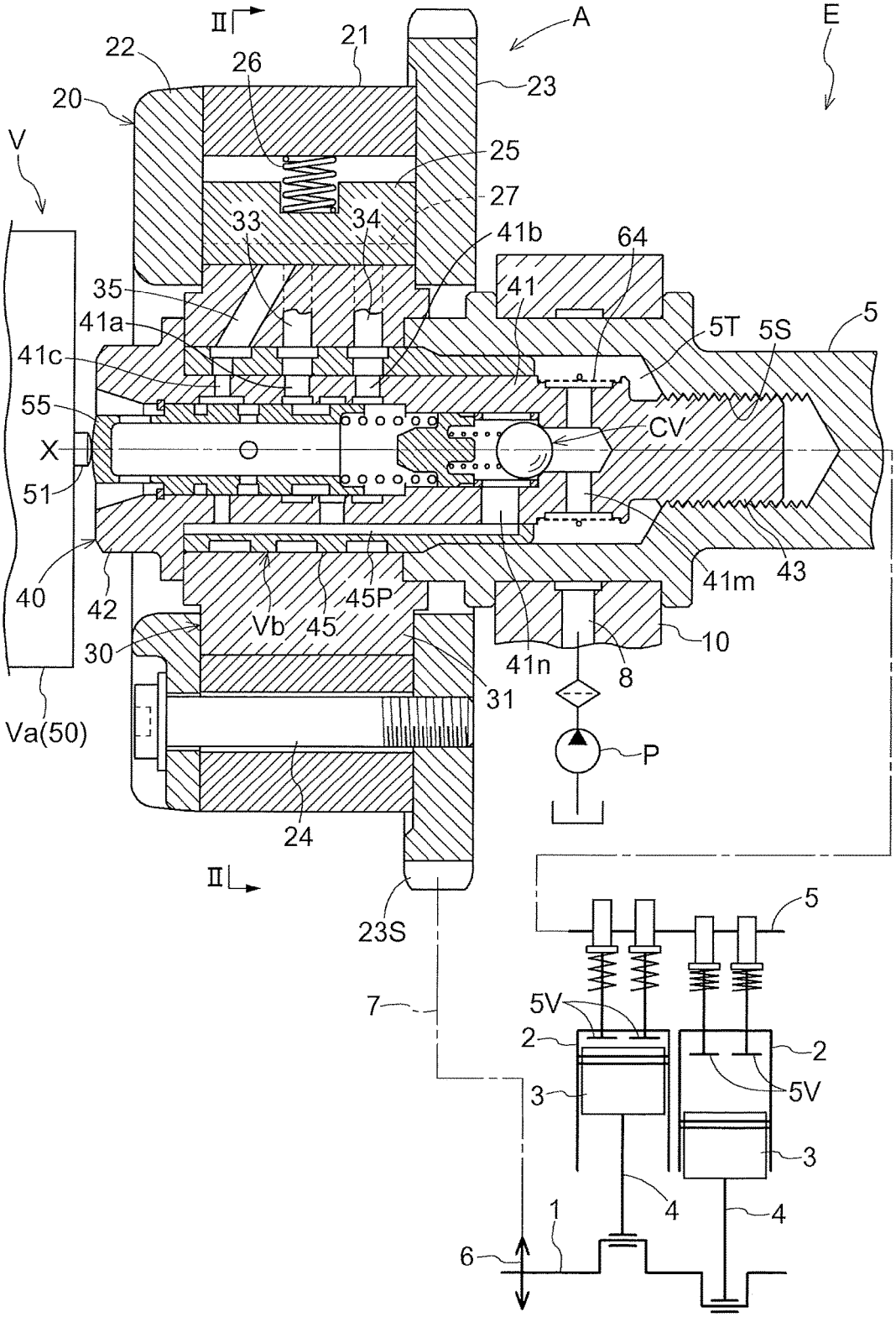
FIG. 1 is a cross sectional view illustrating a variable valve timing control device according to a first embodiment disclosed here.
Figure 2:
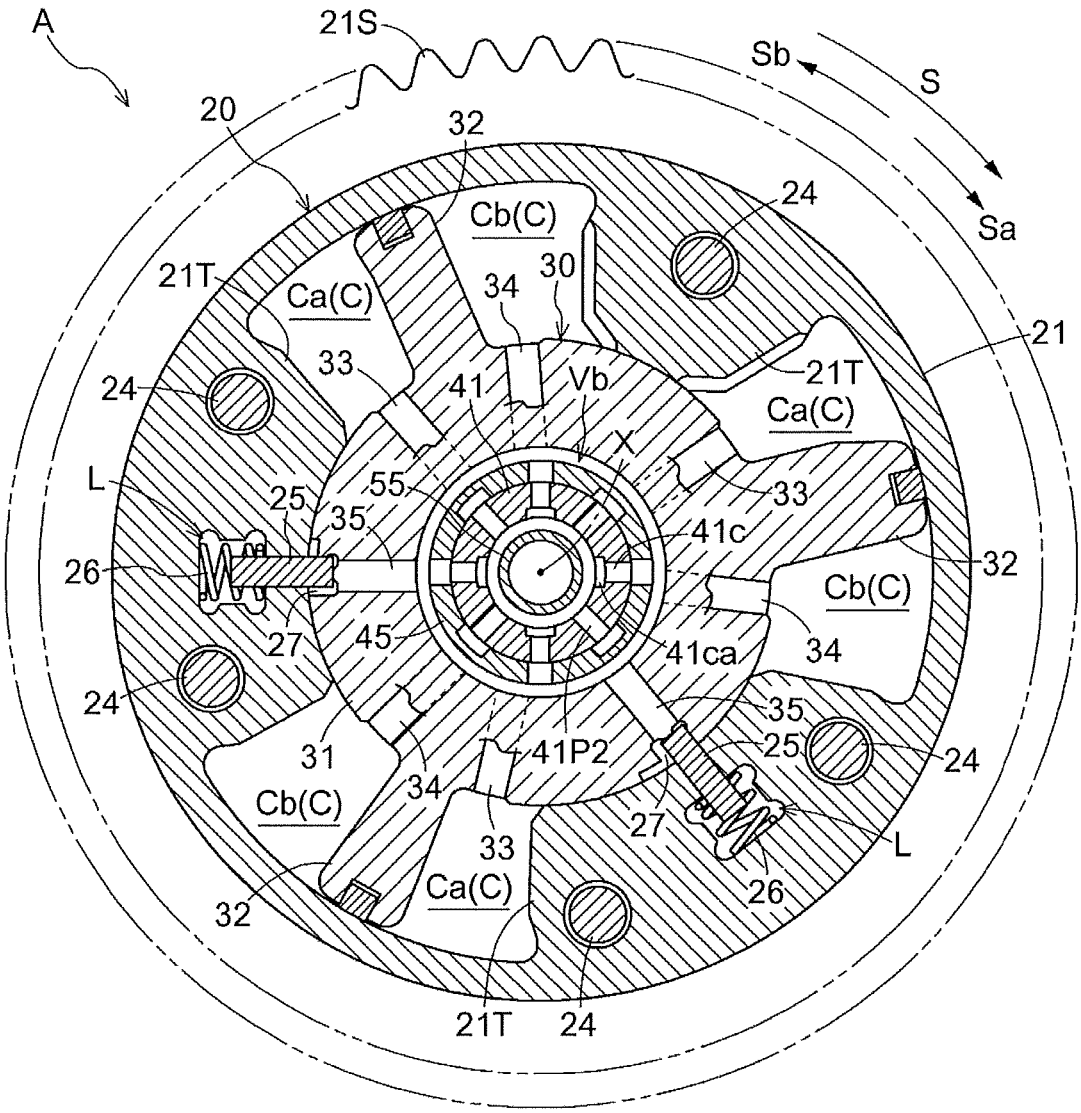
FIG. 2 is a cross sectional view taken along line II-II in FIG. 1.

As illustrated in FIGS. 1 and 2, a variable valve timing control device A includes an outer rotor 20 serving as a drive-side rotational body, an inner rotor 30 serving as a driven-side rotational body, and an electromagnetic control valve V controlling operating oil that serves as fluid.

The variable valve timing control device A is coaxially provided with a rotary axis X of an intake camshaft 5 (i.e., serving as a camshaft) for setting of an opening and closing timing of the intake cam shaft 5 of an engine E (an example of an internal combustion engine) of a vehicle, for example, an automobile.

The inner rotor 30 (an example of the driven-side rotational body) is coaxially disposed with the rotary axis X of the intake camshaft 5, and is connected thereto by a connecting bolt 40 so as to integrally rotate therewith. An outer rotor 20 (an example of the drive-side rotational body) houses the inner rotor 30, is coaxially disposed with the rotary axis X, and synchronously rotates with a crankshaft 1 of the engine E. From this configuration, the outer rotor 20 and the inner rotor 30 are relatively rotatable with each other.

The variable valve timing control device A includes a lock mechanism L maintaining the relative rotational phase of the outer rotor 20 and the inner rotor 30 in an intermediate lock phase illustrated in FIG. 2. The intermediate lock phase is at an opening and closing timing suitable for a start of the engine E, and a control for shifting to the intermediate lock phase is performed when the engine E is controlled to be stopped.

The electromagnetic control valve V includes an electromagnetic unit Va and a valve unit Vb supported by the engine E. The valve unit Vb includes a connecting bolt 40 and a spool 55 that is housed in an inner space 40R of the connecting bolt 40.

The electromagnetic unit Va includes a solenoid portion 50, and a plunger 51 that is coaxially disposed with the rotary axis X so as to extend and retract by the drive control of the solenoid portion 50. The spool 55 of the valve unit Vb controlling the supply and discharge of operating oil (an example of an operation fluid) is coaxially disposed with the rotary axis X. The positional relationship between the plunger 51 and the spool 55 is set such that a protruding end of the plunger 51 makes in contact with an outer end of the spool 55.

The electromagnetic control valve V operates the spool 55 by setting the protruding amount of the plunger 51 by the control of the electricity supplied to the solenoid portion 50. This operation sets the opening and closing timing of intake valves 5V by controlling the flow of the operating oil, and switches the lock mechanism L in a lock state and in an unlock state.

[Engine E and Variable Valve Timing Control Device]

As illustrated in FIG. 1, the engine E houses pistons 3 inside cylinder bores of cylinder blocks 2 arranged at an upper portion, and corresponds to a four-cycle-type engine in which connecting rods 4 connect the pistons 3 and the crankshaft 1. The engine E includes the intake camshaft 5 opening and closing the intake valves 5V, and an exhaust camshaft at the upper portion.

An engine configuration member 10 rotatably supporting the intake camshaft 5 includes a supply flow path 8 supplying the operating oil from an oil hydraulic pump P driven by the engine E. The oil hydraulic pump P supplies lubricating oil accumulated in an oil pan of the engine E to the electromagnetic control valve V via the supply flow path 8, the lubricating oil serving as the operating oil (an example of fluid).

A timing chain 7 is wound over an output sprocket 6, provided at the crankshaft 1 of the engine E, and a timing sprocket 23S of the outer rotor 20. Accordingly, the outer rotor 20 synchronously rotates with the crankshaft 1. A sprocket is also provided at a frond end of the exhaust camshaft provided at an exhaust side, and is wound with the timing chain 7.

As illustrated in FIG. 2, the outer rotor 20 rotates in a drive rotary direction S by the drive force from the crankshaft 1. A direction in which the inner rotor 30 relatively rotates with the outer rotor 20 in the same direction as the drive rotary direction S is referred to as an advanced-angle direction Sa, and the opposite direction thereof is referred to as a retarded-angle direction Sb. In the variable valve timing control device A, a relationship between the crankshaft 1 and the intake camshaft 5 is set so as to enhance an intake compression ratio in response to an increase of a displacement amount when the relative rotational phase is displaced in an advanced-angle direction Sa, and so as to reduce the intake compression ratio in response to the increase of the displacement amount when the relative rotational phase is displaced in a retarded-angle direction Sb.

In the first embodiment, the variable valve timing control device A includes the intake camshaft 5. Alternatively, the variable valve timing control device A may include the exhaust camshaft or include both the intake camshaft 5 and the exhaust camshaft.

[Outer Rotor and Inner Rotor]

As illustrated in FIG. 1, the outer rotor 20 includes an outer rotor main body 21, a front plate 22, and a rear plate 23 which are integrally fixed by plural fixing bolts 24. The timing sprocket 23S is provided at the outer circumference of the rear plate 23.

As illustrated in FIG. 2, the outer rotor main body 21 is integrally provided with plural protrusions 21T protruding inwardly in a radial direction. The inner rotor 30 includes a columnar inner rotor main body 31 that is closely in contact with the protrusions 21T of the outer rotor main body 21, and plural vane portions 32 protruding outwardly in the radial direction from the outer circumference of the inner rotor main body 31 so as to be in contact with an inner circumferential surface of the outer rotor main body 21.

As such, the outer rotor 20 houses the inner rotor 30, and plural fluid pressure chambers C each is provided at the outer circumference of the inner rotor main body 31 at a middle position of the protrusions 21T disposed next to each other in a rotational direction (that is, the fluid pressure chamber C is sandwiched by the protrusions 21T disposed next to each other in the rotational direction). The fluid pressure chambers C each is defined by the vane portion 32 to include an advanced-angle chamber Ca and a retarded-angle chamber Cb. Moreover, the inner rotor main body 31 is provided with advanced-angle paths 33 communicating with the advanced-angle chambers Ca, respectively, and retarded-angle paths 34 communicating with the retarded-angle chambers Cb, respectively.

As illustrated in FIGS. 1 and 2, the lock mechanism L includes a lock member 25, a lock spring 26, and a lock recessed portion 27 (i.e., serving as a recessed portion). The lock member 25 is supported so as to be extendable and retractable in a radial direction relative to each of the two protrusions 21T of the outer rotor 20. The lock spring 26 biases the lock member 25 in a protruding direction thereof. The lock recessed portion 27 is provided at the outer circumference of the inner rotor main body 31. The inner rotor main body 31 is provided with a lock control flow path 35 communicating with the lock recessed portion 27.

The lock mechanism L functions to restrict the relative rotational phase to the intermediate lock phase by the simultaneous engagement of the two lock members 25 with the lock recessed portion 27 being supported with the biasing force of the lock spring 26. In the lock state, the lock member 25 is released from the lock recessed portion 27 to release the lock state against the biasing force of the lock spring 26 by the supply of the operating oil to the lock control flow path 35. On the other hand, the lock member 25 engages with the lock recessed portion 27 with the biasing force of the lock spring 26 to be shifted to the lock state by the discharge of the operating oil from the lock control flow path 35.

The lock mechanism L may be configured such that the single lock member 25 engages with the corresponding single lock recessed portion 27. Furthermore, the lock mechanism L may be configured such that the lock member 25 is guided so as to move along the rotary axis X.

[Connecting Bolt]

Figures 3, 4:
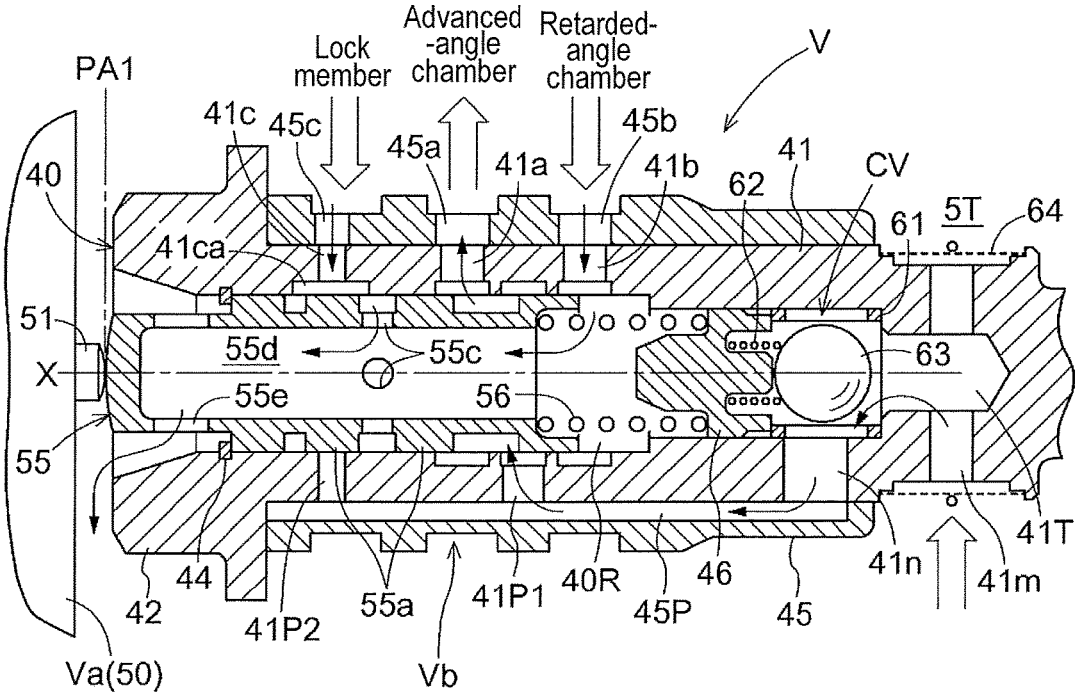
FIG. 3 is a table showing a relationship between a position of a spool and a supply and discharge of an operating oil.
FIG. 4 is a cross sectional view of a valve unit in which the spool is disposed at a first advanced-angle position.
Figure 11:
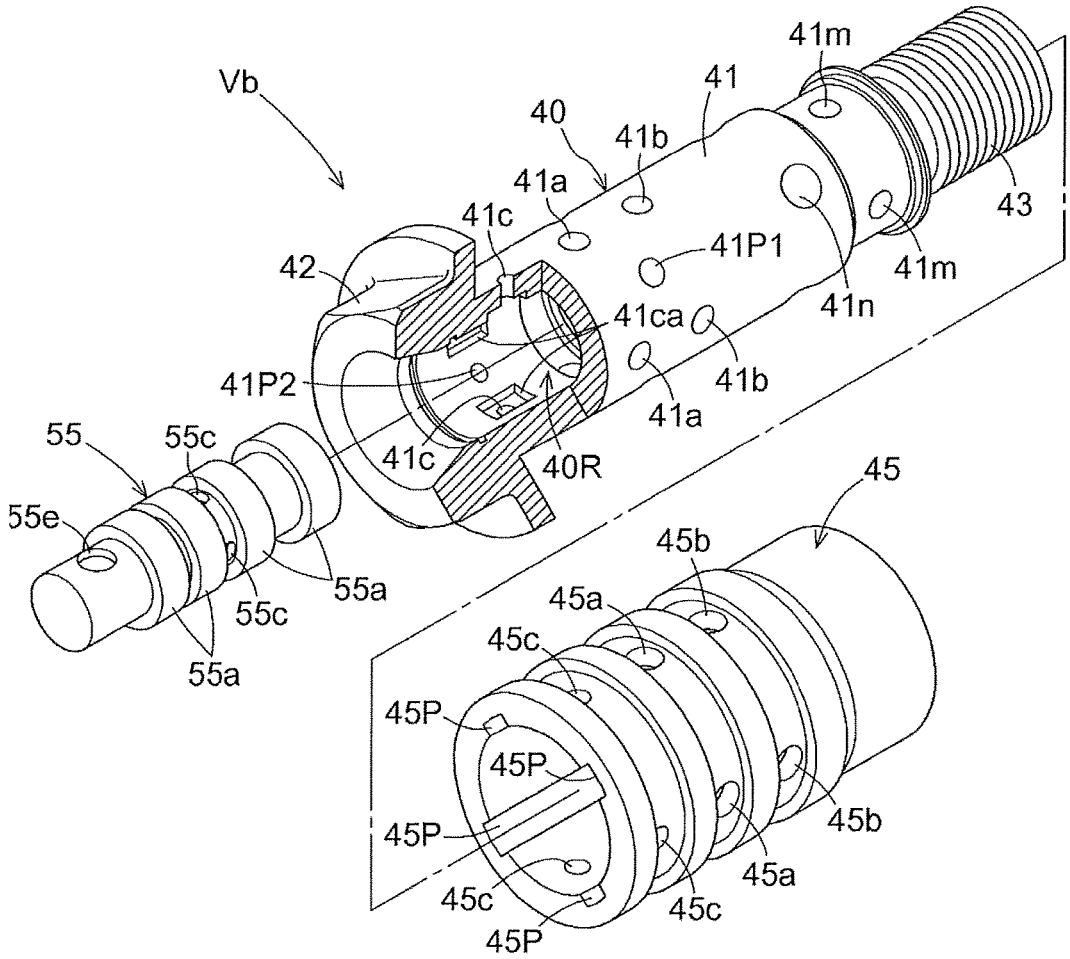
FIG. 11 is an exploded perspective view of the valve unit.

As illustrated in FIGS. 1, 4 and 11, the connecting bolt 40 is provided with a bolt main body 41 that is partially formed in a cylindrical shape, and a cylindrical sleeve 45 being outwardly fitted on the cylindrical part of a bolt main body 41. The connecting bolt 40 and the sleeve 45 are relatively unrotatable about the rotary axis X by, for example, the fitting structure.

The intake camshaft 5 is provided with a female screw portion 5S about the rotary axis X, and a shaft inner space 5T having a diameter larger than that of the female screw portion 5S so that the sleeve 45 is closely fitted thereto. The shaft inner space 5T communicates with the supply flow path 8 and is supplied with the operating oil from the oil hydraulic pump P.

An outer end portion of the bolt main body 41 is provided with the bolt head portion 42 and the outer circumference of an inner end portion of the bolt main body 41 is provided with a male screw portion 43. From this configuration, the male screw portion 43 of the bolt main body 41 is threaded on the female screw portion 5S of the intake camshaft 5, and the inner rotor 30 is fixed to the intake camshaft 5 by the rotational operation of the bolt head portion 42. In this fixed state, an inner end side (male screw side) of the outer circumference of the sleeve 45 fitted outwardly on the bolt main body 41 is closely in contact with an inner circumferential surface of the shaft inner space 5T, and at the same time, and an outer circumferential surface of an outer end side (bolt head portion) of the sleeve 45 is closely in contact with an inner circumferential surface of the inner rotor main body 31.

The inner space 40R formed in a hole shape in a direction from the bolt head portion 42 toward the male screw portion 43 is provided inside the bolt main body 41. A retainer 46 defines the inner space 40R by being fittingly fixed thereto, and the inner space 40R of the bolt main body 41 and an operating oil chamber 41T come to be in a non-communicated state.

The inner space 40R is formed to include a cylindrical inner surface and houses the spool 55 that is reciprocatingly movable along the rotary axis X. A spool spring 56 is disposed between the inner end of the spool 55 and the retainer 46. Accordingly, the spool 55 is biased to protrude in a direction of an outer end side (a direction of the bolt head portion 42).

The bolt main body 41 includes plural introduction flow paths 41*m* making the operating oil chamber 41T and the shaft inner space 5T communicate with each other, and plural (for example, four) intermediate flow paths 41*n* connecting the operating oil chamber 41T and the plural (for example, four) supply paths 45P.

A check valve CV is provided at a flow path of the operating oil chamber 41T sending the operating oil from the introduction flow path 41*m* to the intermediate flow path 41*n*. The check valve CV is configured with a valve holder 61, a valve spring 62, and a ball-shaped valve body 63.

In the check valve CV, the valve spring 62 is disposed between the retainer 46 and the valve body 63, and the valve body 63 closes a flow path by press-contacting with an opening of the valve holder 61 with the biasing force of the valve spring 62. An oil filter 64 removing dust from the operating oil is provided outwardly relative to an outer end of the introduction flow path 41*m*.

The check valve CV opens the flow path against the biasing force of the valve spring 62 in a case where the pressure level of the operating oil supplied to the operating oil chamber 41T is greater than a predetermined value. The check valve CV closes the flow path by the biasing force of the valve spring 62 in a case where pressure level of the operating oil is lower than the predetermined value. By this operation, the operating oil is inhibited from counterflowing from the advanced angle chamber Ca or the retarded angle chamber Cb when the pressure level of the operating oil decreases. Accordingly, the variable valve timing control device A is inhibited from changing the phase. The check valve CV closes the flow path in a case where the pressure level at the downstream relative to the check valve CV (for example, the pressure level of the advanced-angle chamber Ca) is greater than the predetermined value.

[Valve Unit]

As illustrated in FIGS. 1, 4, and 11, the valve unit Vb includes the connecting bolt 40, the spool 55 housed so as to be movable in the direction along the rotary axis X relative to the inner space 40R of the connecting bolt 40, and the spool spring 56.

The bolt main body 41 of the connecting bolt 40 is provided with advanced-angle ports 41*a*, retarded-angle ports 41*b*, lock ports 41*c*, first pump ports 41P1, and second pump ports 41P2 are provided as through holes connecting the inner space 40R of the bolt main body 41 and an outer circumferential surface of the bolt main body 41 in addition to the introduction flow paths 41*m* and the intermediate flow paths 41*n*.

The sleeve 45 is provided with advanced-angle supplementary flow paths 45*a* being formed in a through-hole shape, corresponding to the advanced-angle ports 41*a*, and communicating with the advanced-angle flow paths 33. Similarly, the sleeve 45 is provided with retarded-angle supplementary flow paths 45*b* being formed in a through-hole shape, corresponding to the retarded-angle ports 41*b*, and communicating with the retarded-angle flow paths 34. Lock supplementary flow paths 45*c* are formed in a through hole shape, correspond to the lock ports 41*c*, and communicate with the lock control flow paths 35.

The plural (for example, four) advanced-angle ports 41*a*, the plural (for example, four) retarded-angle ports 41*b*, and the plural (for example, four) lock ports 14*c* are provided relative to the bolt main body 41. The plural (for example, four) first pump ports 41P1 and the plural (for example, four) second pump ports 41P2 are provided. The plural (for example, four) supplying paths 45P are provided at a border between the outer circumference of the bolt main body 41 and the sleeve 45. The operating oil from the supplying paths 45P is supplied to the first pump ports 41P1 and the second pump ports 41P2. The supply paths 45P are provided as a groove formed at an inner circumference of the sleeve 45. Alternatively, the supply paths 45P may be provided as a groove formed at the outer circumference of the connecting bolt 40.

The spool 55 is formed in a hollow shape except for a part of an outer end, and is provided with a contact surface that is provided at the outer end of the spool 55 and that is in contact with the plunger 51. A drain flow path 55*d* is provided inside the spool 55. The spool 55 is provided with plural land portions 55*a* at plural parts in the direction along the rotary axis X. Drain hole portions 55*c* communicating with the drain flow path 55*d* inside the spool 55 are provided at groove portions that are provided between the land portions 55*a* that are adjacent to each other. In the vicinity of a protruding end of the spool 55, an outlet 55*e* discharging the operating oil from the drain flow path 55*d* is provided. The spool 55 makes in contact with the stopper 44 that is provided at an inner circumference of an opening disposed at an outer end side of the connecting bolt 40 so that the position of the protruding end of the spool 55 is defined as shown in FIG. 4. This position corresponds to a first advanced-angle position PA1. The stopper 44 is configured as a snap ring mounted on the inner circumference of an outer end side of the inner space 40R of the connecting bolt 40.

Figure 9:
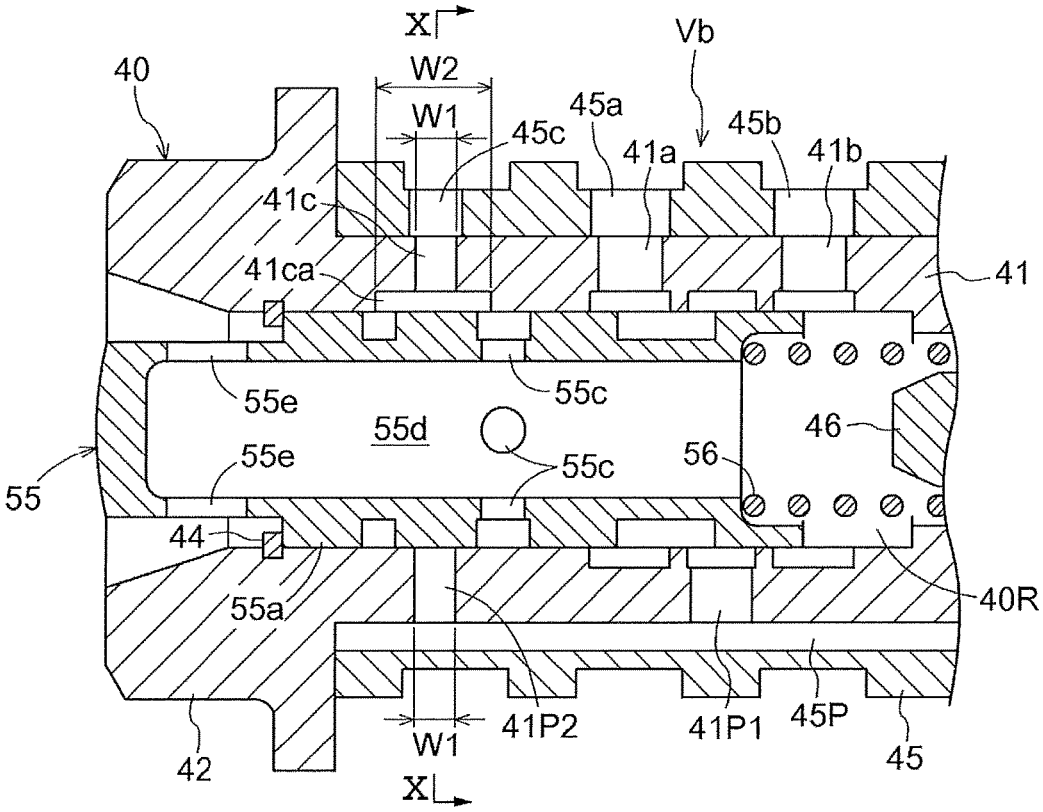
FIG. 9 is an enlarged cross sectional view of a part of a lock port.
Figure 10:
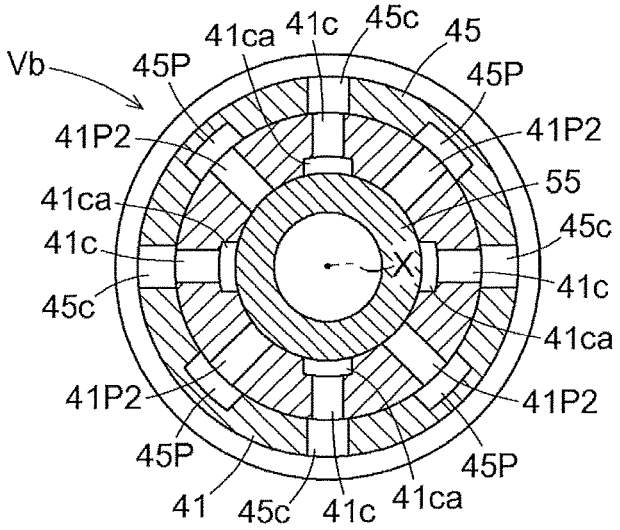
FIG. 10 is a cross sectional view taken along line X-X in FIG. 9.

Specifically, as illustrated in FIGS. 9 and 10, communication portions 41*ca* are provided at parts exposing to the inner space 40R of the connecting bolt 40. The lock ports 41*c* and the second pump ports 41P2 are disposed at positions overlapping with each other in the direction along the rotary axis X, and being different from each other in a circumferential direction.

As shown in FIG. 9, respective widths (opening diameters) of the lock port 41*c* and the second pump port 41P2 in the direction along the rotary axis X are set as a first opening width W1, and a second opening width W2 of the communication portion 41*ca* is set larger than the first opening width W1.

Moreover, in the configuration, the lock port 41*c* is disposed at an outer end side relative to both the advanced-angle port 41*a* and the retarded-angle port 41*b* in the direction along the rotary axis X (the most outer end side of the connecting bolt 40, left in FIG. 1). In this disposition, in a case where the operating oil of the lock control flow path 35 is discharged to the drain flow path 55*d* when the lock mechanism L is unlocked (in a case where the spool 55 is disposed at the first advanced-angle position PA1 in FIG. 4), and in a case where the operating oil is discharged from an outer end position of the spool 55 (in a case where the spool 55 is disposed at a first retarded-angle position PB1 in FIG. 8), the inconvenience in which the discharged operating oil is inhibited from discharging by the influence of the operating oil discharged from the advanced-angle chamber Ca and the retarded-angle chamber Cb is eliminated.

[Operation Mode]

In the variable valve timing control device A of the disclosure, in a state where the electricity is not supplied to the solenoid portion 50 of the electromagnetic unit Va, the pressing force is not applied from the plunger 51 to the spool 55. As illustrated in FIG. 4, the spool 55 is maintained at a position where the land portions 55*a* that are disposed at an outer position of the spool 55 are in contact with the stopper 44 by the biasing force of the spool spring 56.

Here, the position of the spool 55 corresponds to the first advanced-angle position PA1 as shown in FIG. 4, and when the electricity supplied to the solenoid portion 50 of the electromagnetic unit Va is increased, as shown in FIG. 3, the spool 55 may be operable in a second advanced-angle position PA2, the neutral position PN, a second retarded-angle position PB2, and the first retarded-angle position PB1 in the aforementioned order. That is, by the setting of the electricity supplied to the solenoid portion 50 of the electromagnetic unit Va, the spool 55 may be operated to be disposed at one of the five operation positions.

Figure 5:
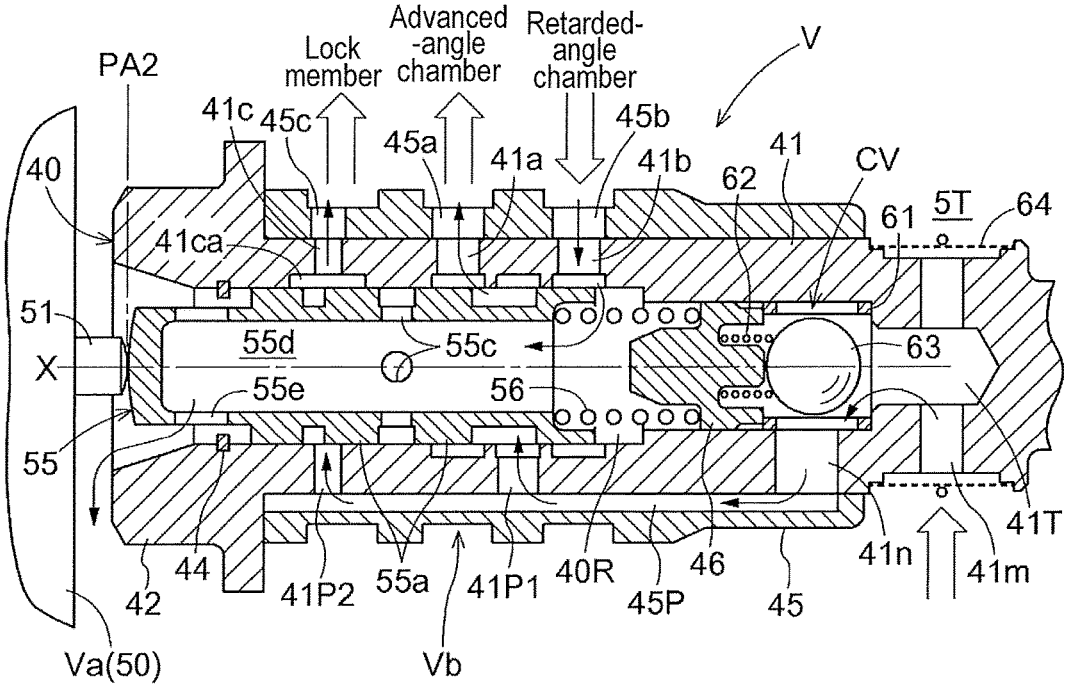
FIG. 5 is a cross sectional view of the valve unit in which the spool is disposed at a second advanced-angle position.
Figure 6:
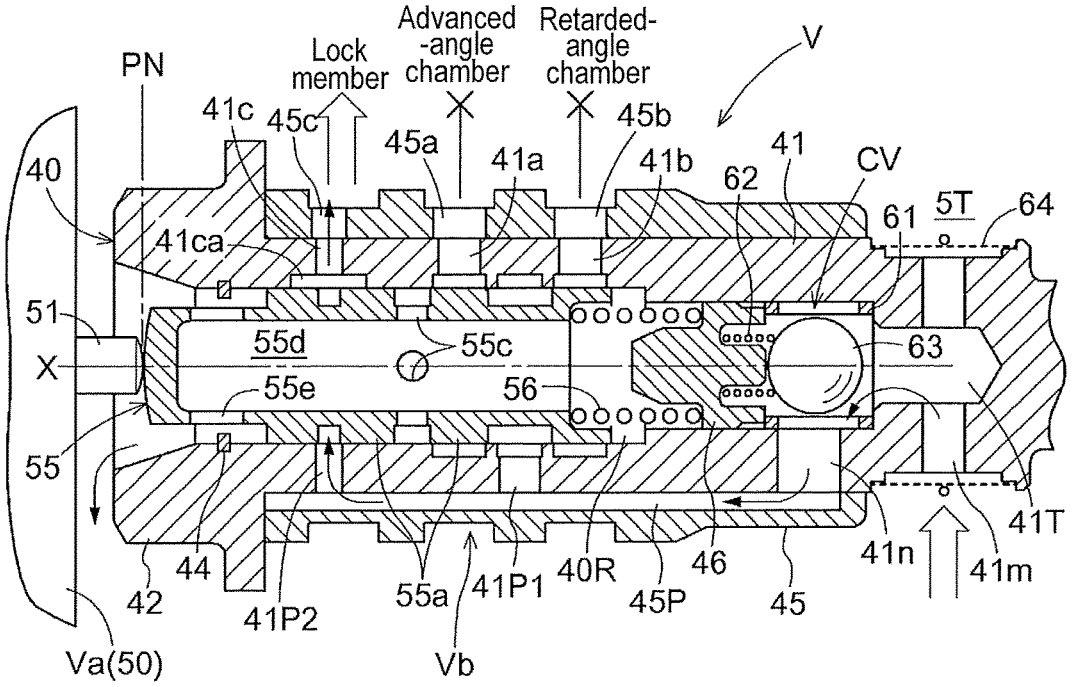
FIG. 6 is a cross sectional view of the valve unit in which the spool is disposed at a neutral position.
Figure 7:
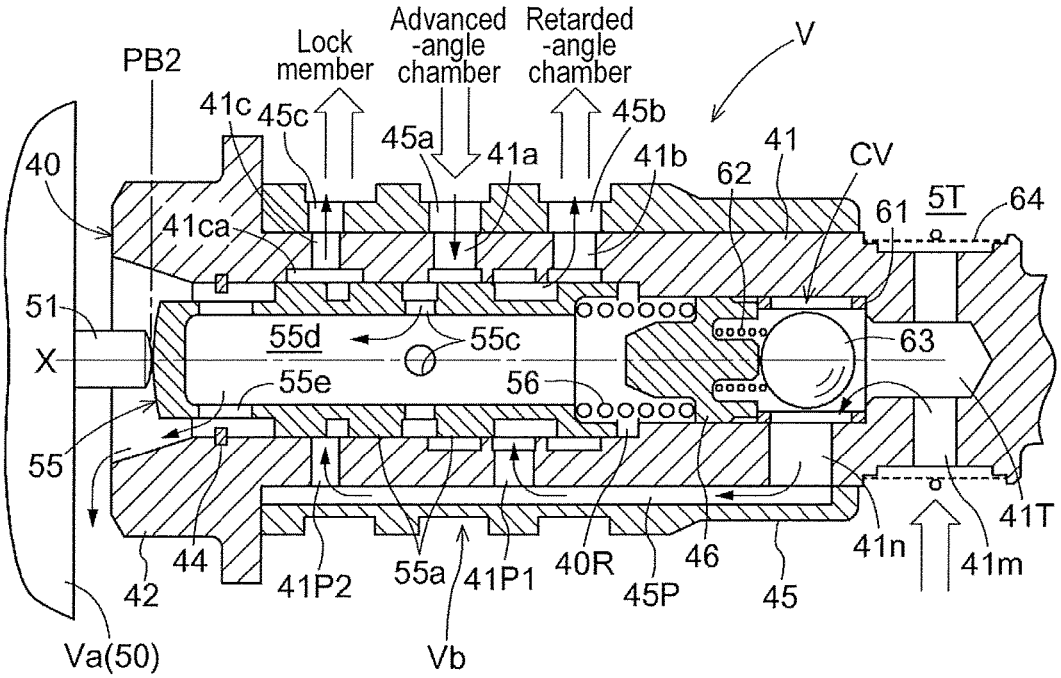
FIG. 7 is a cross sectional view of the valve unit in which the spool is disposed at a second retarded-angle position.
Figure 8:
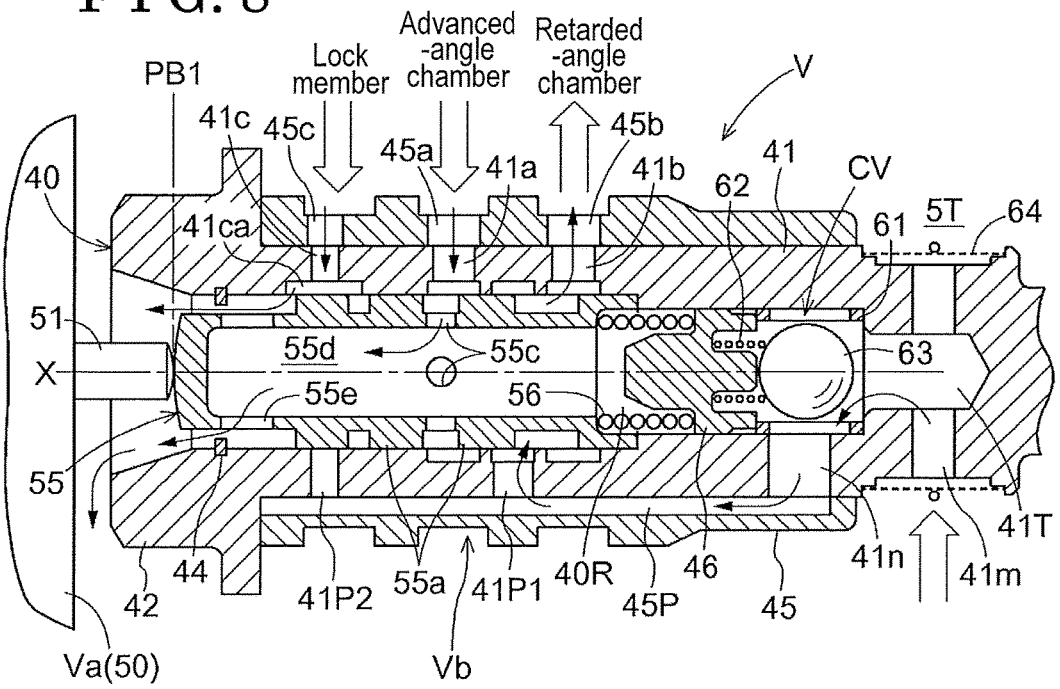
FIG. 8 is a cross sectional view of the valve unit in which the spool is disposed at a first retarded-angle position.

As illustrated in FIGS. 4 and 8, in the valve unit Vb, the first advanced-angle position PA1 and the first retarded-angle position PB1 correspond to a lock position, and as illustrated in FIGS. 5 to 7, the second advanced-angle position PA2, the neutral position PN, and the second retarded-angle position PB2 correspond to an unlock position. In the lock position, the lock mechanism L may be shifted in a lock state, and in the unlock position, the lock mechanism L is released from the lock state (in a case of being already released, the lock mechanism L is maintained in the unlock state). The electricity supplied to the solenoid portion 50 comes to be the greatest in a case where the spool 55 is operated to be disposed at the first retarded-angle position PB1.

As illustrated in FIGS. 4 and 5, in a case where the spool 55 is operated to be disposed at either the first advanced-angle position PA1 or the second advanced-angle position PA2, the operating oil from the first pump port 41P1 flows to the advanced-angle port 41*a* via the spool 55, and is supplied to the advanced-angle chamber Ca from the advanced-angle flow path 33. At the same time, the operating oil of the retarded-angle chamber Cb flows from the retarded-angle flow path 34 to the retarded-angle port 41*b*, and is discharged from the outlet 55*e* by flowing from the opening of an inner end side of the spool 55 to the drain flow path 55*d*.

Specifically, in the first retarded-angle position PA1, as shown in FIG. 4, the second pump port 41P2 is blocked by the land portion 55*a*, and the operating oil of the lock recessed portion 27 flows from the lock control flow path 35 to the lock port 41*c*, and flows from the drain hole portion 55*c* to another drain hole 5*c* of the spool 55. Accordingly, the operating oil flows in the drain hole portions 55*c* that are disposed ahead of the communication portion 41*ca* of the lock port 41*c* and the end portion of the land portion 55*a*. Thus, the operating oil finally flows to the drain flow path 55*d*, and is discharged from the outlet 55*e*. Accordingly, the relative rotational phase is displaced in the advanced-angle direction Sa, and the lock mechanism L is shifted in the lock state when the relative rotational phase reaches the intermediate lock phase.

Moreover, as shown in FIG. 5, the operating oil from the second pump port 41P2 is supplied to the lock port 41*c* in the second advanced-angle position PA2, and is supplied to the lock recessed portion 27 via the lock control flow path 35. Accordingly, the lock member 25 is pulled out from the lock recessed portion 27, and the relative rotational phase continuously moves in the advanced-angle direction Sa in a state where the lock mechanism L is unlocked.

In a case where the spool 55 is operated to be disposed in the neutral position PN, as illustrated in FIG. 6, the pair of land portions 55*a* is disposed at positions where both the advanced-angle port 41*a* and the retarded-angle port 41*b* are closed, and the operating oil is blocked from supplying and discharging relative to the advanced-angle chamber Ca and the retarded-angle chamber Cb so that the relative rotational phase is maintained.

In the neutral position PN, the operating oil from the second pump port 41P2 is supplied to the lock port 41*c*, and is supplied from the lock port 41*c* to the lock recessed portion 27 via the lock control flow path 35. Accordingly, the lock member 25 is maintained in the pulled out state from the lock recessed portion 27, and the lock mechanism L is maintained in the unlock state.

As illustrated in FIGS. 7 and 8, in a case where the spool 55 is operated to be disposed either at the second retarded-angle position PB2 or the first retarded-angle position PB1, the operating oil from the first pump port 41P1 flows in the retarded-angle port 41*b* via the spool 55, and is supplied from the retarded-angle flow path 34 to the retarded-angle chamber Cb. At the same time, the operating oil of the retarded angle Ca flows from the advanced-angle flow path 33 to the advanced-angle port 41*a*, flows from the opening of the inner end side of the spool 55 to the drain flow path 55*d*, and is discharged from the outlet 55*e*.

Specifically, in the second retarded-angle position PB2, as illustrated in FIG. 7, the operating oil from the second pump gate 41P2 is supplied to the lock port 41*c*, and is supplied to the lock recessed portion 27 via the lock control flow path 35. Accordingly, the lock member 25 is pulled out from the lock recessed portion 27, and the relative rotational phase continuously moves in the retarded-angle direction Sb in a state where the lock mechanism L is unlocked.

As shown in FIG. 8, in the first retarded-angle position PB1, the second pump port 41P2 is blocked by the land portion 55*a*, the operating oil in the lock recessed portion 27 flows from the lock control flow path 35 to the lock port 41*c*, and is discharged outside the connecting bolt 40 from the outer end position of the spool 55. In a case where the operating oil flows in such a manner, the operating oil may be discharged outside by the drain hole portions 55*c* that are disposed ahead of the communication portion 41*ca* of the lock port 41*c* and the end portion of the land portion 55*a*. Accordingly, the relative rotational phase is displaced in the retarded-angle direction Sb, and the lock mechanism L is shifted in the lock state when the relative rotational phase reaches the intermediate lock state.

[Action and Effect of the Embodiment]

From this configuration, comparing to, for example, a configuration in which the lock port 41*c* and the second pump port 41P2 are formed in parallel to each other at the connecting bolt 40 in the direction along the rotary axis X, because the dimension of the connecting bolt 40 in the direction along the rotary axis X may be reduced, the spool 55 may be shortened, and as a result, the variable valve control device A may be downsized.

Specifically, because the communication portion 41*ca* of the lock port 41*c* is provided at an inner circumferential surface of the bolt main body 41 to flow the operating oil in the aforementioned way, for example, comparing to the configuration disclosed in Patent reference 1 in which the two lock control flow paths are provided, the oil path may be simply configured.

Because the lock port 41*c* is disposed at the outer end side of the connecting bolt 40 in the direction along the rotary axis X relative to both the advanced-angle port 41*a* and the retarded-angle port 41*b*, when the lock mechanism L is shifted in the lock state, the operating oil discharged from the lock control flow path 35 is discharged without having an effect of a flow of the operating oil already remained inside the drain flow path 55*d* of the spool 55, and the lock mechanism L may be quickly shifted in the lock state.

That is, in the configuration in which the operating oil is supplied to the advanced-angle port 41*a* and is discharged from the retarded-angle port 41*b* to the drain flow path 55*d*, the pressure level of the operating oil at the drain flow path 55*d* increases. On the other hand, the operating oil discharged from the lock port 41*c* may be sent to an area where the pressure level decreases at the downstream of the drain flow path 55*d*, and therefore, the pressure level of the lock control flow path 35 is decreased to quickly shift the relative rotational phase in the lock state by reducing the effect of the pressure level of the operating oil flowing in the drain flow path 55*d*.

In the configuration in which the operating oil from the lock control flow path 35 is discharged without having an effect of the operating oil in the drain flow path 55*d*, for example, the quick discharge is available to securely shift the lock mechanism L in the lock state in a case where the oil temperature level of the operating oil is low and the viscosity thereof is high.

Second Embodiment

The disclosure may be configured as below other than the aforementioned first embodiment. The same components as those described in the first embodiment are marked with the same reference numerals.

Figure 12:
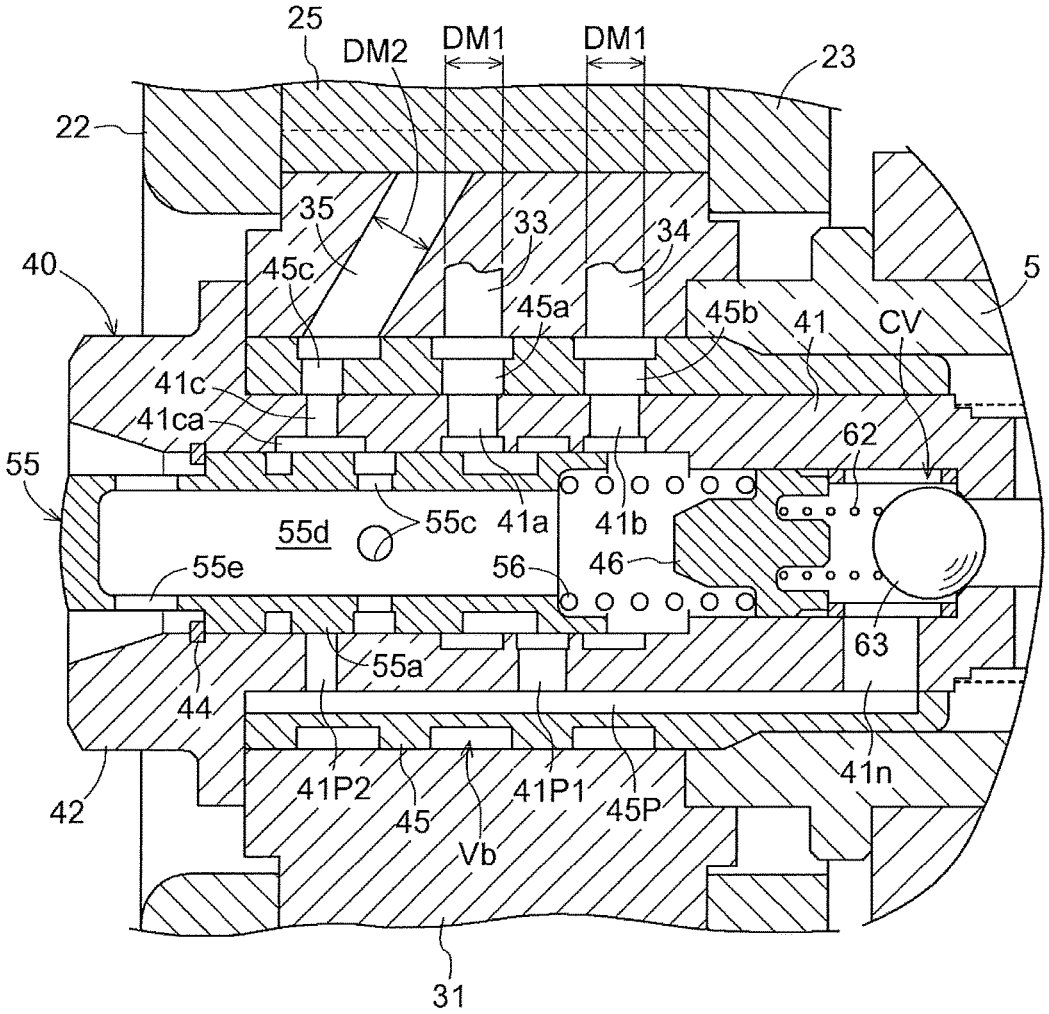
FIG. 12 is a cross sectional view of a valve unit of a second embodiment.

As illustrated in FIG. 12, the cross sectional area of the lock control flow path 35 is set larger than both of the cross sectional areas of the advanced-angle flow path 33 and the retarded-angle flow path 34. In a second embodiment, a diameter of the advanced-angle flow path 33 and a diameter of the diameter flow path 34 correspond to DM1, a diameter of the lock control glow path 35 corresponds to DM2, and the relation is set such that DM1 is smaller than DM2.

That is, in the flow path formed in a hole shape, because the flow path resistance decreases as the cross sectional area of the flow path increases, the operating oil is quickly discharged and the lock mechanism L is quickly and securely shifted in the lock state by increasing the cross sectional area of the lock control flow path 35. Increasing the diameters of the advanced-angle chamber 33, the retarded-angle chamber 34, and the lock control flow path 35 is effective when thinking of the flow path resistance. However, the variable valve timing control device A may upsize. Accordingly, the upsizing of the variable valve timing control device A is inhibited by having the difference between the diameters of the flow paths.

Another modified example of the embodiment will hereunder be explained. The lock port 41*c* provided at the connecting bolt 40 is provided as the through hole including the cross sectional shape of the communication portion 41*ca* (see FIG. 9). That is, because the lock port 41*c* is provided as the through hole entirely having the second opening width W2, the lock port 41*c* may be easily formed.

Still another modified example of the embodiment will hereunder be explained. In the first embodiment, the spool 55 may be operated to be disposed at the fifth operation positions. Alternatively, for example, the spool 55 may be operated to be disposed at four operation positions by setting the operation areas so as not to include the first advanced-angle position PA1.

In a configuration in which the spool 55 operates to be disposed at four operating positions that do not include the first advanced-angle position PA1, in a case where the relative rotational phase is shifted in the lock state at the intermediate lock phase, the relative rotational phase is set at the advanced-angle side relative to the intermediate lock phase, and the relative rotational phase is displaced in the retarded-angle direction Sb by the spool 55 that is operated to be disposed at the first position PB1, and is shifted in the lock state.

Comparing to the aforementioned embodiments, in still further modified example of the embodiment, the valve unit Vb may be configured such that the advanced-angle port 41*a* and the retarded-angle port 41*b* are disposed reversely, and the advanced-angle supplementary flow path 45*a* and the retarded-angle supplementary flow path 45*b* are disposed reversely.

INDUSTRIAL APPLICABILITY

This disclosure may be used for a variable valve timing control device controlling a relative rotational phase of a drive-side rotary body and a driven-side rotary body by a fluid pressure and maintains the relative rotational phase to a predetermined phase by a lock mechanism.

According to the aforementioned embodiments, the variable valve timing control device (A) includes the drive-side rotational body (the outer rotor 20) rotating synchronously with the crankshaft (1) of the internal combustion engine (the internal combustion engine E), the driven-side rotational body (the inner rotor 30) being coaxially disposed with the rotary axis (X) of the drive-side rotational body (the outer rotor 20), and rotating integrally with a camshaft (the intake cam shaft 5) for opening and closing the valve, the advanced-angle chamber (Ca) being formed between the drive-side rotational body (the outer rotor 20) and the driven-side rotational body (the inner rotor 30), the retarded-angle chamber (Cb) being formed between the drive-side rotational body (the outer rotor 20) and the driven-side rotational body (the inner rotor 30), the lock mechanism (L) including the recessed portion (the lock recessed portion 27) being formed at one of the drive-side rotational body (the outer rotor 20) and the driven-side rotational body (the inner rotor 30), and the lock member (25) being formed at the other of the drive-side rotational body (the outer rotor 20) and the driven-side rotational body (the inner rotor 30), the lock member (25) being selectively engageable with the recessed portion (27), and the valve unit (Vb) including the connecting bolt (40) which is coaxially disposed with the rotary axis (X), and which connects the driven-side rotational body (the inner rotor 30) to the camshaft (the intake cam shaft 5). The connecting bolt (40) is formed with the advanced-angle port (41*a*) communicating with the advanced-angle chamber (Ca), the retarded-angle port (41*b*) communicating with the retarded-angle chamber (Cb), at least one lock port (41*c*) communicating with the recessed portion (the lock recessed portion 27), the first pump port (41P1) supplying the fluid from outside to the advanced-angle port (41*a*) and the retarded-angle port (41*b*), and the second pump port (41P2) supplying the fluid from outside to the lock port (41*c*). The advanced-angle port (41*a*), the retarded-angle port (41*b*), the lock port (41*c*), the first pump port (41P1), and the second pump port (41P2) are formed as through holes each of which connects the inner space and the outer circumferential surface of the connecting bolt (40). The lock port (41*c*) is formed at the same position as the position of the second pump port (41P2) in the direction along the rotary axis (X), and is disposed different from the second pump port (41P2) in the circumferential direction. The valve unit (Vb) includes the spool (55) having the plural land portions (55*a*) at the outer circumference of the spool (55), and being formed with the drain flow path (55*d*) inside the spool (55), the valve unit (Vb) housing the spool (55) which is movable in the direction along the rotary axis (X) relative to the inner space of the connecting bolt (40). The valve unit (Vb) allows the second pump port (41P2) and the lock port (41*c*) to communicate with each other in a case where the spool (55) is set at the unlock position where the lock state of the lock mechanism (L) is released, and the valve unit (Vb) closes the second pump port (41P2) with the land portion (55*a*) of the spool (55) and allows the lock port (41*c*) to communicate with the drain flow path (55*d*) in a case where the spool (55) is set at the lock position where the lock mechanism (L) is allowed to be shifted in the lock state.

According to the aforementioned configuration, the relative rotational phase may be set by controlling the supply of the fluid from the first pump port (41P1) to one of the advanced-angle port (41*a*) and the retarded-angle port (41*b*) by the operation of the spool (55), and by draining the fluid from the other of the advanced-angle port (41*a*) and the retarded-angle port (41*b*) to the drain flow path (55*d*) inside the spool (55). Furthermore, the operation of the spool (55) releases the lock state of the lock mechanism (L) by supplying the fluid from the second pump port (41P2) to the lock port (41*c*), and allows the lock mechanism (L) to be shifted in the lock state by discharging the fluid from the lock port (41*c*) to the drain flow path (55*d*) inside the spool (55). Specifically, in this configuration, the supply and discharge of the fluid is controlled by the spool (55) disposed coaxially with the rotary axis (X), and each of the distances between the advanced-angle chamber (Ca) and the spool (55), the retarded-angle chamber (Cb) and the spool (55), and the lock recessed portion (27) and the spool (55) may be shortened, and therefore, the great responsiveness may be achieved. In this characteristic configuration, the second pump port (41P2) and the lock port (41*c*) are disposed at the same position in the direction along the rotary axis (X), and at the different position in the circumferential direction. Accordingly, comparing to the configuration in which the second pump port (41P2) and the lock port (41*c*) are disposed in parallel to each other in the direction along the rotary axis (X), the dimension in the direction of the rotary axis (X) may be shortened. Thus, the variable valve timing control device that is downsized and that may shift a lock mechanism (L) to a lock state with great responsiveness without deteriorating an advantage of the disposition of a spool (55) coaxially with a rotary axis (X) may be configured.

According to the aforementioned embodiments, the communication portion (41*ca*) of the lock port (41*c*) communicates with one of the drain hole portion (55*c*) and the outer circumference of the distal end portion of the spool (55) when the lock mechanism (L) is in the lock state.

Accordingly, when the lock mechanism (L) is in the lock state, the communication portion (41*ca*) of the lock port (41*c*) communicates with one of the drain hole portion (55*c*) of the spool (55) and the outer circumference of the distal end portion of the spool (55) to discharge the fluid from the lock port (41*c*) to maintain the lock state of the lock mechanism (L).

According to the aforementioned embodiments, the drain flow path (55*d*) of the spool (55) is configured to discharge the fluid from the outlet (55*e*) of the end portion of the outer end side of the spool (55). The lock port (41*c*) is disposed outwardly relative to both the advanced-angle port (41*a*) and the retarded-angle port (41*b*) in the direction along the rotary axis (X).

In this configuration, because the pressure level of the fluid in the vicinity of the outlet (55*e*) inside the drain flow path (55*d*) is low, and because the fluid is discharged from the lock port (41*c*) to the drain flow path (55*d*) in the vicinity of the outlet (55*e*), the lock mechanism (L) may be quickly shifted in the lock state by decreasing the influence of the fluid disposed in the drain flow path (55*d*). Specifically, because the drain flow path (55*d*) is closer to the outlet (55*e*) relative to the advanced-angle port (41*a*) and the retarded-angle port (41*b*), the drain flow path (55*d*) is not easily affected by the discharged fluid, and may smoothly discharge the fluid even when the fluid is discharged from one of the advanced-angle chamber (Ca) and the retarded-angle chamber (Cb).

In the aforementioned configuration, the variable valve timing control device (A) further includes the advanced angle flow path (33) being formed between the advanced-angle chamber (Ca) and the advanced-angle port (41*a*), the retarded angle flow path (34) being formed between the retarded-angle chamber (Cb) and the retarded-angle port (41*b*), and the lock control flow path (35) being formed between the lock port (41*c*) and the recessed portion (the lock recessed portion 27). The cross-sectional area of the lock control flow path (35) is set larger than respective cross-sectional areas of the advanced-angle flow path (33) and of the retarded-angle flow path (34).

Accordingly, because the cross-sectional area of the lock control flow path (35) is set larger than respective cross-sectional areas of the advanced-angle flow path (33) and of the retarded-angle flow path (34), the lock mechanism (L) may be more quickly shifted in the lock state by decreasing the flow path resistance when the fluid is discharged from the lock control flow path (35).

According to the aforementioned embodiments, the plural lock ports (41*c*) are provided at the inner circumferential surface of the connecting bolt (40) in the circumferential direction.

Accordingly, because the fluid may be discharged via the plural lock ports (41*c*), comparing to a case where, for example, the single lock port (41*c*) is provided, the lock mechanism (L) may be more quickly shifted in the lock state.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A variable valve timing control device, comprising:

a drive-side rotational body rotating synchronously with a crankshaft of an internal combustion engine;

a driven-side rotational body being coaxially disposed with a rotary axis of the drive-side rotational body, and rotating integrally with a camshaft for opening and closing a valve;

an advanced-angle chamber being formed between the drive-side rotational body and the driven-side rotational body;

a retarded-angle chamber being formed between the drive-side rotational body and the driven-side rotational body;

a lock mechanism including a recessed portion being formed at one of the drive-side rotational body and the driven-side rotational body, and a lock member being formed at the other of the drive-side rotational body and the driven-side rotational body, the lock member being selectively engageable with the recessed portion; and a valve unit including a connecting bolt which is coaxially disposed with the rotary axis, and which connects the driven-side rotational body to the camshaft; wherein the connecting bolt is formed with an advanced-angle port communicating with the advanced-angle chamber;

a retarded-angle port communicating with the retarded-angle chamber;

at least one lock port communicating with the recessed portion;

a first pump port supplying a fluid from outside to the advanced-angle port and the retarded-angle port; and a second pump port supplying the fluid from outside to the lock port;

the advanced-angle port, the retarded-angle port, the lock port, the first pump port, and the second pump port are formed as through holes each of which connects an inner space and an outer circumferential surface of the connecting bolt;

the lock port is formed at a same position as a position of the second pump port in the direction along the rotary axis, and is disposed different from the second pump port in a circumferential direction;

the valve unit includes a spool having a plurality of land portions at an outer circumference of the spool, and being formed with a drain flow path inside the spool, the valve unit housing the spool which is movable in the direction along the rotary axis relative to the inner space of the connecting bolt; and the valve unit allows the second pump port and the lock port to communicate with each other in a case where the spool is set at an unlock position where a lock state of the lock mechanism is released, and the valve unit closes the second pump port with the land portion of the spool and allows the lock port to communicate with the drain flow path in a case where the spool is set at a lock position where the lock mechanism is allowed to be shifted in the lock state.

2. The variable valve timing control device according to claim 1, wherein a communication portion of the lock port communicates with one of a drain hole portion and an outer circumference of a distal end portion of the spool when the lock mechanism is in the lock state.

3. The variable valve timing control device according to claim 1, wherein the drain flow path of the spool is configured to discharge the fluid from an outlet of an end portion of an outer end side of the spool; and the lock port is disposed outwardly relative to both the advanced-angle port and the retarded-angle port in the direction along the rotary axis.

4. The variable valve timing control device according to claim 2, wherein the drain flow path of the spool is configured to discharge the fluid from an outlet of an end portion of an outer end side of the spool; and the lock port is disposed outwardly relative to both the advanced-angle port and the retarded-angle port in the direction along the rotary axis.

5. The variable valve timing control device according to claim 1, further comprising:

an advanced angle flow path being formed between the advanced-angle chamber and the advanced-angle port;

a retarded angle flow path being formed between the retarded-angle chamber and the retarded-angle port; and a lock control flow path being formed between the lock port and the recessed portion, wherein a cross-sectional area of the lock control flow path is set larger than respective cross-sectional areas of the advanced-angle flow path and of the retarded-angle flow path.

6. The variable valve timing control device according to claim 2, further comprising:

an advanced angle flow path being formed between the advanced-angle chamber and the advanced-angle port;

a retarded angle flow path being formed between the retarded-angle chamber and the retarded-angle port; and a lock control flow path being formed between the lock port and the recessed portion, wherein a cross-sectional area of the lock control flow path is set larger than respective cross-sectional areas of the advanced-angle flow path and of the retarded-angle flow path.

7. The variable valve timing control device according to claim 3, further comprising:

an advanced angle flow path being formed between the advanced-angle chamber and the advanced-angle port;

a retarded angle flow path being formed between the retarded-angle chamber and the retarded-angle port; and a lock control flow path being formed between the lock port and the recessed portion, wherein a cross-sectional area of the lock control flow path is set larger than respective cross-sectional areas of the advanced-angle flow path and of the retarded-angle flow path.

8. The variable valve timing control device according to claim 1, wherein the plurality of lock ports is provided at an inner circumferential surface of the connecting bolt in the circumferential direction.

9. The variable valve timing control device according to claim 2, wherein the plurality of lock ports is provided at an inner circumferential surface of the connecting bolt in the circumferential direction.

10. The variable valve timing control device according to claim 3, wherein the plurality of lock ports is provided at an inner circumferential surface of the connecting bolt in the circumferential direction.

11. The variable valve timing control device according to claim 5, wherein the plurality of lock ports is provided at an inner circumferential surface of the connecting bolt in the circumferential direction.

* * * * *